US007015268B2

(12) United States Patent
Manwiller et al.

(10) Patent No.: US 7,015,268 B2
(45) Date of Patent: Mar. 21, 2006

(54) METHOD FOR MAKING MICROABRASIVE TOOLS

(75) Inventors: Kenneth E. Manwiller, New Ipswich, NH (US); Anne B. Hardy, Acton, MA (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 671 days.

(21) Appl. No.: 10/050,662

(22) Filed: Jan. 16, 2002

(65) Prior Publication Data

US 2002/0088183 A1 Jul. 11, 2002

Related U.S. Application Data

(62) Division of application No. 09/363,581, filed on Jul. 29, 1999.

(51) Int. Cl.
*C08K 3/34* (2006.01)

(52) U.S. Cl. ..... 524/444; 524/424; 524/430

(58) Field of Classification Search ..... 524/424, 524/430, 444

See application file for complete search history.

(56) References Cited

U.S. PATENT DOCUMENTS

| | | | | |
|---|---|---|---|---|
| 3,874,856 A | | 4/1975 | Leeds | 51/296 |
| 4,326,052 A | | 4/1982 | Kang et al. | 536/1 |
| 4,634,453 A | | 1/1987 | Hay et al. | 51/293 |
| 4,677,082 A | | 6/1987 | Alford et al. | 501/88 |
| 5,028,362 A | | 7/1991 | Janney et al. | 264/25 |
| 5,086,093 A | | 2/1992 | Miller | 524/28 |
| 5,215,946 A | | 6/1993 | Minh | 501/97 |
| 5,250,251 A | | 10/1993 | Fanelli et al. | 264/328.2 |
| 5,279,994 A | | 1/1994 | Kerkar | 501/94 |
| 5,304,223 A | | 4/1994 | Pieper et al. | 51/293 |
| 5,340,532 A | | 8/1994 | Bergström | 419/38 |
| 5,367,068 A | | 11/1994 | Lane et al. | 536/124 |
| 5,401,284 A | | 3/1995 | Sheldon et al. | 51/308 |
| 5,401,445 A | | 3/1995 | Menchhofer | 264/13 |
| 5,563,106 A | | 10/1996 | Binner et al. | 501/84 |
| 5,654,027 A | | 8/1997 | Chalupa | 426/573 |
| 5,665,440 A | | 9/1997 | Menchhofer | 428/34.5 |
| 5,667,742 A | | 9/1997 | Dwivedi et al. | 264/658 |
| 5,721,026 A | * | 2/1998 | Feder et al. | 428/35.4 |
| 5,772,953 A | | 6/1998 | Sambrook et al. | 264/638 |

FOREIGN PATENT DOCUMENTS

| | | |
|---|---|---|
| EP | 0 288 208 B1 | 2/1996 |
| GB | 2 289 466 B | 10/1997 |
| JP | 401266838 | 10/1989 |
| JP | 09 001461 A | 1/1997 |
| WO | WO 95/30631 | 11/1995 |
| WO | WO 96/10471 | 4/1996 |
| WO | WO 97/29886 | 8/1997 |

OTHER PUBLICATIONS

Monsanto Co., Kelcogel (R) Gellan Gum (visited Oct. 7, 1999) <http://www.nutrasweekkelco.com/ingred/kel-gc.htm>.

Ogbemi O. Omatete et al., Gelcasting-A New Ceramic Forming Process, 70 Ceramic Bulletin 1641, 70(10) (1991).

Albert C. Young et al., Gelcasting of Alumina, *J. Am. Ceram. Soc.*, 74:612-618 (1991).

Monsanto Co., *A User's Guide to KELCOGEL (R ) Gellan Gum* (company brochure) RC-177 (1996).

Cheftel et al., "Gelation" in Amino Acids, Peptides and Proteins in Food Chemistry (Owen R. Fennema, ed.) 290-294 (1985).

Clark, R. C. (Kelco Div., Merck & Co., Inc., USA), Research Disclosure 34512 (1993).

* cited by examiner

*Primary Examiner*—Edward J. Cain
(74) *Attorney, Agent, or Firm*—Hamilton, Brook, Smith & Reynolds, P.C.

(57) ABSTRACT

A microabrasive tool is formed from a slurry including liquid, abrasive grains, a bonding material, and a polymer—for example, gellan gum. The slurry is cast in a mold, and the polymer is ionically cross-linked. Cross-linking the polymer fixes the structure of the bonding material and the abrasive grains, wherein the abrasive grains are dispersed substantially uniformly within the bonding material. The ionically cross-linked structure of bonding material and abrasive grains can then be fired to form a microabrasive tool.

27 Claims, 3 Drawing Sheets

METHOD FOR MAKING MICROABRASIVE TOOLS

RELATED APPLICATION

This application is a divisional of application Ser. No. 09/363,581 (now 6,375,692), filed Jul. 29, 1999, the entire teachings of which are incorporated herein by reference.

BACKGROUND OF THE INVENTION

Superfinishing is a process used to remove small amounts of stock from a workpiece. Superfinishing is commonly performed after grinding to achieve the following objectives: removing an amorphous surface layer produced by grinding, decreasing surface roughness, improving part geometry, and providing a desired surface topography. The removal of the amorphous layer improves the wear resistance of the workpiece. The decreased surface roughness further increases the load-bearing capability of the workpiece, and the characteristic topographical pattern aids in oil retention.

Superfinishing is generally performed using a vitreous-bonded microabrasive tool formed of abrasive particles in a bond matrix. "Microabrasive" tools are generally defined as abrasive tools wherein the size of the abrasive particles is 240 grit (63 micrometers or microns) or finer. Microabrasive tools are generally manufactured according to one of a couple well-established processes.

According to one process, abrasive grains and a bonding material are mixed with binders assisted by a small amount of liquid (e.g., less than 4% by weight). The liquid usually is water. This "semi"-dry mix then is cold pressed to shape and green density. Finally, the green form is fired to produce a microabrasive tool.

Another even-older process for making microabrasive products is the so-called "puddle" process. According to the puddle process, the abrasive grains and the bonding material are mixed with enough water to produce a pourable slurry. Consequently, the puddle process is considered a wet process. The slurry is poured into a mold and allowed to dry. The dried mixture is then fired to produce an abrasive tool.

One advantage of the puddle process is that by mixing the abrasive grains and the bonding material in a slurry, a better distribution of the abrasive grains and the bonding material (i.e., better mixing) can be obtained compared with what is typically obtained with dry or semi-dry mixing.

Nevertheless, in both of these forming methods, abrasive products are produced in which particles of the bonding material and the abrasive are nonuniformly dispersed. In the semi-dry process, this nonuniform dispersion is due to incomplete mixing of the bonding material and the abrasive grains. In the wet process, the nonuniformity is generally due to settling of the bonding material and the abrasive grains relative to one another.

SUMMARY OF THE INVENTION

The invention is generally directed to a method for making a microabrasive tool, and a slurry and green stage article from which the microabrasive tool is formed.

In a method of this invention, the microabrasive tool is fabricated by casting a slurry that includes a liquid, abrasive grains, a bonding material, a polymer, and at least one cross-linking agent to form a structure of a green cast article.

The polymer is then ionically cross-linked within the mold, wherein the ionically cross-linked polymer fixes the structure of the green cast article.

The slurry of the invention includes a liquid, abrasive grains, a bonding material, an ionically cross-linkable polymer and at least one cross-linking agent.

The green stage article of the invention includes abrasive grains, a vitrified glass, and an ionically cross-linked polymer.

The method of this invention can be employed to manufacture microabrasive tools having improved homogeneity over products formed by conventional semi-dry-press and puddle processes. Mixing the abrasive grains and bond material in a slurry takes advantage of the more uniform distribution of components than generally obtainable by known wet processes. It does so, however, without the typical drawbacks of conventional wet processes. In the methods of this invention, the quick-setting action of the polymer fixes, or locks in, the microstructure of this homogeneous system, reducing or eliminating the tendency of nonuniform settling observed in wet processes. Consequently, the cast article has more uniform density and hardness in comparison to articles made in accordance with known methods. The improved homogeneity of the microabrasive tool promotes greater consistency, evenness and efficiency in the superfinishing performance of the microabrasive tool. Additionally, high-quality cast articles can be produced more consistently with the methods of this invention, and product reject rates consequently can be reduced. Further still, the methods of this invention are adaptable and generally are inexpensive to conduct.

DETAILED DESCRIPTION OF PREFERRED EMBODIMENTS OF THE INVENTION

Figure 1:
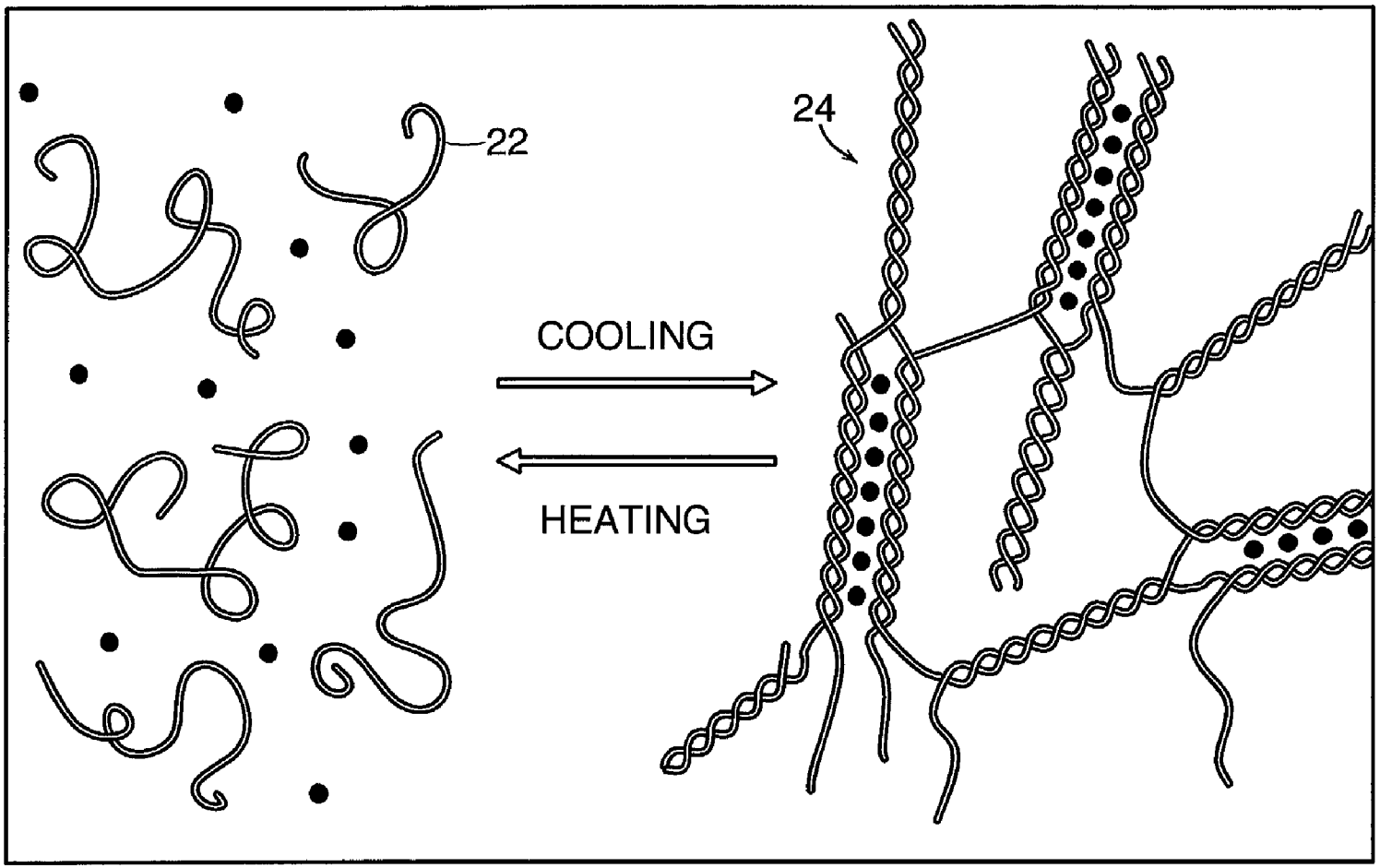
FIG. 1 is an illustration of cross-linking of polymers in accordance with this invention.

The features and other details of the method of the invention will now be more particularly described with reference to the accompanying drawings and pointed out in the claims. It will be understood that the particular embodiments of the invention are shown by way of illustration and not as limitations of the invention. The principal features of this invention can be employed in various embodiments without departing from the scope of the invention.

The method of the invention includes casting a slurry that includes a liquid, abrasive grains, a bonding material, an ionically cross-linking polymer and a cross-linking agent. The components of the slurry can be combined in any order. However, it is preferred that the polymer be mixed with the liquid component, followed by addition of the abrasive grains. Thereafter, the bonding material and, finally, a cation source, are added to complete the slurry.

The slurry is cast in a suitable mold, and then cooled to cause ionic cross-linking of the polymer to form a green cast article. The green cast article is oven-dried and subsequently fired to vitrify the bonding material and to remove the ionically cross-linked polymer.

The liquid component of the slurry is employed to cause the slurry to be sufficiently fluid for casting. Examples of suitable liquids include water and mixtures of water with minor amounts of alcohol or organic solvent(s), pH modifier(s), rheology modifiers, dispersant(s) and mixtures thereof. Preferably, the liquid is deionized (DI) water. In an especially preferred embodiment, the liquid component includes a dispersant, which is employed to assist in dispersion and stabilization of abrasive grains in the slurry. A preferred dispersant is an ammonium polyacryate solution, such as Darvan® 821A ammonium polyacryate solution (manufactured by R. T. Vanderbilt of Norwalk, Conn., USA). Ammonium citrate is another suitable dispersant that can be employed. In other embodiments, a non-ionic surfactant, such as an octylphenol ethylene oxide condensate (available under the trademark, TRITON X-100, from Union Carbide, Danbury, Conn., USA), can serve as the dispersant. Typically, the dispersant is present in the liquid component in a range of between about 0.01 and about 10 percent, by volume, preferably 1 to 6 percent. In a preferred embodiment, the amount of dispersant is about two percent, by volume, of the liquid component.

The abrasive is a granular material suitable for removing material from metal, ceramic materials, composites and other workpieces. Any abrasive grains can be employed. Examples of especially suitable abrasive grains include those formed of aluminum oxide, alumina zirconia, sol gel sintered alpha-alumina, silicon carbide, diamond, cubic boron nitride, and mixtures thereof. The abrasive grains generally are present in a range between about 80 weight-percent and about 95 weight-percent of the solids, and also in a range of between about 55 weight-percent to about 70 weight-percent of the overall slurry. Examples of the density of suitable abrasive grains include a density of about 3.21 $g/cm^3$ for SiC, about 3.5 $g/cm^3$ for diamond, and about 3.95 $g/cm^3$ for $Al_2O_3$.

The slurry is kept sufficiently fluid to pour and to prevent or remove air bubbles. Preferably, the solids content of the slurry is no more than about 45% by volume, to prevent excessive slurry viscosity. Further, slurry viscosity generally becomes more dependent on solids loading as the particle size becomes finer because smaller particles generally are harder to disperse. For example, the viscosity of a slurry having a solids content of about 45% by volume can be acceptable where the grit size is at, or near, about 320 grit, while the viscosity of a slurry having a solids content of more than about 43% by volume and a grit size of 1000 grit might not be acceptable.

Generally, the diameter of abrasive grains is in a range between about 1800 grit and about 320 grit (which is between about 1 and about 29 microns). Products having abrasive grains of about 30 microns or less are preferred for use in the methods of this invention.

In the time between when the slip is poured and when it gels, the abrasive particles have an opportunity to settle. The rate at which the particles settle depends, in part, on the size of the particles and the viscosity of the slip. With either an increase in the size of the particles or a decrease in the viscosity of the slurry, the rate at which the particles settle will increase. For example, while minimal settling has been observed with abrasive grains that are about 600 grit (about 8 microns) or finer, 320-grit abrasive grains can exhibit higher settling rates at a preferred slurry viscosity.

The settling rate of the slurry can be reduced by increasing its viscosity. Viscosity can be increased, for example, by adding a water soluble polymer, such as an acrylic polymer or polyvinyl alcohol. In a specific embodiment, viscosity can be increased by adding polyvinyl alcohol to the slurry. In particularly preferred embodiments, polyvinyl alcohol solutions can be added to the slurry in the amount of about 4% (Airvol® 203, Air Products and Chemicals), or about 6% (Airvol® 205, Air Products and Chemicals) by weight of the liquid components of the slurry. Examples of suitable polyvinyl alcohol solutions include Airvol® 203 and Airvol® 205, both of which are available from Air Products and Chemicals, Inc. Bubble formation consequent to the addition of polyvinyl alcohol can be reduced or eliminated by adding a suitable defoaming agent, such as an oil.

The bonding material is a suitable vitreous bond, such as is known in the art. Examples of suitable vitreous bonds are described in U.S. Pat. No. 5,401,284, issued to Sheldon et al., the teachings of which are incorporated herein by referenced in their entirety. In a preferred embodiment, the bonding material includes an aluminosilicate ($Al_2O_3.SiO_2$) glass, but can also include other components, such as clay, feldspar and/or quartz. The bonding material typically is in the form of glass frit particles, or glass bond mixtures, suitable for being fired into a vitrified matrix, thereby fixing the abrasive grains in the form of a dispersed and homogeneous composite glassy structure. Suitable glass frit particles generally have a diameter in a range of between about 5 microns and about 30 microns. An especially preferred bonding material for use with this invention is described in "Example 1" of U.S. Pat. No. 5,401,284; the teachings of U.S. Pat. No. 5,401,284 are incorporated herein by reference in their entirety. Generally, the bonding material forms between about 3.5 weight-percent and about 7 weight-percent of the slurry. The density of the bonding material is less than 3.0 $g/cm^3$ and typically ranges from about 2.1 $g/cm^3$ to about 2.7 $g/cm^3$. An example of an especially suitable density of a bonding material is about 2.4 $g/cm^3$. Thus, grain and bond densities are significantly different and particle sizes can be significantly different. Accordingly, the cross-linking polymer should be designed specifically to handle these different materials in combination.

Suitable polymers for use with this invention generally have a viscosity low enough to accommodate high solids loading, are easy to use in manufacturing, and can be rapidly cross-linked. Preferably, the polymer is a water-soluble polysaccharide, gellan gum. Gellan gum is a food grade heteropolysaccharide produced by fermentation of *Pseudomonas elodea* (ATCC 31461) and is commercially available under the trademark, Kelcogel® K9A50 (available from Monsanto, NutraSweet Kelco Co., St. Louis, Mo., USA). Gellan gum typically has a viscosity of about 40–80 cP at 0.1% concentration and 1000–2000 cP at 0.5% concentration when measured at 25° C. with a Brookfield LVF viscometer at 60 rpm. The gum also has a high rheological yield point, a 1% gum solution having a working yield value of 60 $dynes/cm^2$ as defined by the shear stress at a shear rate of 0.01 $s^{-1}$. Further still, the viscosity of the gellan gum typically is unaffected by changes in pH in the range of 3–11. Processes for preparing gellan gum are described in U.S. Pat. Nos. 4,326,052 and 4,326,053, each of which is hereby incorporated by reference in its entirety. Gellan gum traditionally has been used in industry as a gelling agent in food products.

While Kelcogel® K9A50 gellan gum is a preferred polymer for use with this invention, other polymers can be employed. For example, Keltone® LV sodium alginate (Monsanto, NutraSweet Kelco Co., St. Louis, Mo., USA) can be employed. In a preferred embodiment, Keltone® LV sodium alginate is hydrated by mixing the Keltone® LV sodium alginate in a water bath at an elevated temperature, such as a temperature of about 80° C. Suitable acrylate polymers have viscosity characteristics in aqueous dispersions similar to those of gellan gum.

Generally, the amount of polymer employed by methods of this invention is very small relative to the amount of acrylamide or acrylate monomer typically used in ceramic gel-casting techniques. For example, whereas a monomer used in gel-casting typically forms about 15 to 25 weight percent of the total monomer/liquid content, the polymer content employed in this invention typically is in a range of between about 0.2% and about 1.0%, by weight, of the total polymer/liquid content.

A separate cation source is employed as a cross-linking agent to enable or facilitate ionic cross-linking of the polymer. Examples of suitable cation sources include calcium chloride ($CaCl_2$) and yttrium nitrate ($Y(NO_3)_3$). Other suitable cations that can be employed include ions of sodium, potassium, magnesium, calcium, barium, aluminum and chromium.

Reducing the concentration of the cross-linking agent reduces the viscosity of the slurry, thereby improving mixing and pouring of the slurry and increasing the achievable solids loading. A relatively low concentration of the cross-linking agent can reduce necessary drying time and energy costs in manufacturing. Where $CaCl_2.2H_20$ is used, for example, a concentration of about 0.4% $CaCl_2.2H_20$ by weight of the liquids can be sufficient to form a suitably rigid, cross-linked structure over a relatively wide range of grit sizes, such as grit sizes from between about 600 to about 1200, and with different bond types. In highly loaded slurries, the concentration of the cross-linking agent can be reduced slightly to improve the flowability of the slurry. In addition, an increase in the cross-linking agent (ion) concentration generally increases the temperature at which cross-linking occurs.

Slurry ingredients can be admixed in a suitable mixer, such as a shear-action mixer or by roller mixing with a ball mill. Preferably, rubber rather than ceramic balls are used to prevent contamination of the slurry. Use of a ball mill can be supplemented with subsequent mixing in a high-shear mixer. The polymer can be added to the slurry after switching to the high-shear mixer and allowed to hydrate, followed by addition of the cross-linking agent.

The slurry is cast in a suitable mold. Molds for casting parts can be made of almost any leak-proof container. Examples of suitable container materials include plastic, metal, glass, Teflon® polytetrafluoroethylene resins (E. I. du Pont de Nemours and Company, Wilmington, Del., USA), and silicone rubber.

As used herein, the term, "cast," means to give form to or to conform to. The polymer is then cross-linked to form an article in which the structure of the abrasive grains and the bonding material is fixed. Cross-linking of discrete polymer chains 22 to form an inter-locked structure 24 is illustrated in FIG. 1. As used herein, the term, "fix," generally means to increase the integrity of the structure and to restrict displacement of each of the different phases relative to one another. Both the temperature at which cross-linking occurs and the rigidity of the fixed structure are dependent on the cation type and concentration.

The cast slurry is cooled to a temperature that causes ionic cross-linking of the polymer component. Typically, the temperature at which cross-linking occurs is below about 45° C. In preferred embodiments, using gellan gum, cross-linking typically occurs upon cooling at, for example, about 34° C. The rate at which the polymer cross-links can be increased by decreasing the atmospheric temperature. As one example, the mold can be cooled in a freezer at, e.g., −25° C. Alternatively, the mold can be cooled in a water bath.

After the polymeric chains have ionically cross-linked to form a matrix, thereby fixing the structure of the solids in the cast slurry, the article is removed from the mold and air or oven dried at room temperature, or at a temperature up to 100° C., e.g., 60 to 80° C., to form a green-stage dried article.

The dried article is fired to vitrify the bonding material and to burn out the polymer component. Generally, firing is conducted at a temperature in a range between about 800° and about 1300° C. Preferably, firing is conducted in an inert atmosphere when the article contains superabrasive (e.g., diamond or cubic boron nitride). In an especially preferred embodiment, the dried article is heated at a rate of 40° C./hr. to 980° C. In this embodiment, the article is held at 980° C. for about 4 hours and then cooled back to about 25° C.

Where the fired article is in the form of a microabrasive tool, the fired article typically will have a porosity in a range of between about 30 and about 70 volume percent. Preferably, porosity will be in a range of between about 40 and about 60 volume percent. The median pore size typically is in a range of between about 3 and about 10 microns, and the pores are substantially uniformly dispersed throughout the article. The abrasive grains, likewise, are well dispersed throughout the structure.

A typical microabrasive product can take the form, for example, of a wheel, stick, stone, cylinder, cup, disk or cone. As previously mentioned, microabrasive tools formed by the methods of this invention can be employed to superfinish a variety of workpieces. Superfinishing generally involves a high-frequency, low-amplitude oscillation of the microabrasive against a rotating workpiece. This process typically is conducted at relatively low temperatures and at relatively low pressures (i.e., less than 90 pounds per square inch). The amount of stock removed from the article's surface typically is less than about 25 microns. Examples of such workpieces include ball and roller bearings as well as bearing raceways, wherein the surfaces are superfinished to impart a low-roughness finish and improve part geometry such as roundedness. Other applications for bonded-abrasive products of the invention include, but are not limited to, honing and polishing operations.

When a bonded-abrasive product, such as a microabrasive stick, is used to superfinish a workpiece, such as a bearing raceway, abrasive grains at the surface of the stick superfinish the workpiece by cutting, plowing or rubbing the surface of the workpiece. The mechanical forces produced by these mechanisms break down the bond, which holds the abrasive grains in a skeletal structure. As a result, the superfinishing surface of the microabrasive stick retreats, and fresh abrasive grains embedded within the skeletal structure are continuously exposed to cut the surface of the workpiece. Pores in the structure provide means for collecting and removing swarf (i.e., chips removed during superfinishing) to preserve a clean interface between the microabrasive stick and the workpiece. The pores also provide means for coolant flow at the interface of the tool and the workpiece.

Because superfinishing tools are used for fine finishing of precision components, small irregularities in the tool composition make the tool unsatisfactory. Thus, by creating a uniform homogeneous structure, the method of the invention results in superior superfinishing tools.

EXEMPLIFICATION

Example 1

Tables 1 and 2, below, indicate preferred masses of each of the various components used to form 200-g batches of slurry of this invention. In the compositions of Table 1, the mass of the bonding material ($m_b$) is about 6 weight-percent of the mass of the abrasive ($m_a$). In the compositions of Table 2, $m_b$ is about 10 weight-percent of $m_a$. The "volume percent solids" column indicates the volume percent of the slurry formed by the abrasive and bonding material, combined. The samples described in the rows in each chart range from about 30 to about 45 volume-percent solids, though smaller and larger volume percentages can also be used. Preferably, however, the solids are limited to less than about 60 volume-percent of the slurry because, at solids percentages beyond about 60 volume-percent, the viscosity of the slurry can exceed that which is practical for use with the methods of this invention. In Tables 1 and 2, the density of the abrasive is 3.95 g/cm$^3$ and the density of the bond is 2.4 g/cm$^3$.

TABLE 1

($m_b$ = 0.06 $m_a$)

| Volume % Solids | Weight % Solids | g Solids | g $H_2O$ & Dispers. | g gel Polymer | g grain ($Al_2O_3$) | g Bond | g $CaCl_2$—$2H_2O$ | g Disper-sant |
|---|---|---|---|---|---|---|---|---|
| 30 | 62.33 | 124.65 | 73.35 | 0.440 | 117.60 | 7.05 | 0.293 | 1.467 |
| 31 | 63.43 | 126.85 | 71.15 | 0.427 | 119.67 | 7.18 | 0.285 | 1.423 |
| 32 | 64.49 | 128.99 | 69.01 | 0.414 | 121.69 | 7.30 | 0.276 | 1.380 |
| 33 | 65.53 | 131.06 | 66.94 | 0.402 | 123.65 | 7.42 | 0.268 | 1.339 |
| 34 | 66.54 | 133.08 | 64.92 | 0.390 | 125.55 | 7.53 | 0.260 | 1.298 |
| 35 | 67.52 | 135.03 | 62.97 | 0.378 | 127.39 | 7.64 | 0.252 | 1.259 |
| 36 | 68.47 | 136.93 | 61.07 | 0.366 | 129.18 | 7.75 | 0.244 | 1.221 |
| 37 | 69.39 | 138.78 | 59.22 | 0.355 | 130.93 | 7.85 | 0.237 | 1.184 |
| 38 | 70.29 | 140.58 | 57.42 | 0.345 | 132.62 | 7.96 | 0.230 | 1.148 |
| 39 | 71.16 | 142.33 | 55.67 | 0.334 | 134.27 | 8.05 | 0.223 | 1.113 |
| 40 | 72.01 | 144.03 | 53.97 | 0.324 | 135.88 | 8.15 | 0.216 | 1.079 |
| 41 | 72.84 | 145.69 | 52.31 | 0.314 | 137.44 | 8.24 | 0.209 | 1.046 |
| 42 | 73.65 | 147.30 | 50.70 | 0.304 | 138.97 | 8.34 | 0.203 | 1.014 |
| 43 | 74.44 | 148.87 | 49.13 | 0.295 | 140.45 | 8.42 | 0.197 | 0.983 |
| 44 | 75.20 | 150.41 | 47.59 | 0.286 | 141.90 | 8.51 | 0.190 | 0.952 |
| 45 | 75.95 | 151.90 | 46.10 | 0.277 | 143.31 | 8.60 | 0.184 | 0.922 |

TABLE 2

($m_b$ = 0.10 $m_a$)

| Volume % Solids | Weight % Solids | g Solids | g $H_2O$ & Dispers. | g gel Polymer | g grain ($Al_2O_3$) | g Bond | g $CaCl_2$—$2H_2O$ | g Disper-sant |
|---|---|---|---|---|---|---|---|---|
| 30 | 62.02 | 124.04 | 73.96 | 0.444 | 112.76 | 11.27 | 0.296 | 1.479 |
| 31 | 63.12 | 126.25 | 71.75 | 0.431 | 114.77 | 11.48 | 0.287 | 1.435 |
| 32 | 64.20 | 128.39 | 69.61 | 0.418 | 116.72 | 11.67 | 0.278 | 1.392 |
| 33 | 65.24 | 130.47 | 67.53 | 0.405 | 118.61 | 11.86 | 0.270 | 1.351 |
| 34 | 66.25 | 132.49 | 65.51 | 0.393 | 120.45 | 12.04 | 0.262 | 1.310 |
| 35 | 67.23 | 134.46 | 63.54 | 0.381 | 122.24 | 12.22 | 0.254 | 1.271 |
| 36 | 68.18 | 136.37 | 61.63 | 0.370 | 123.97 | 12.40 | 0.247 | 1.233 |
| 37 | 69.11 | 138.23 | 59.77 | 0.359 | 125.66 | 12.56 | 0.239 | 1.195 |
| 38 | 70.02 | 140.03 | 57.97 | 0.348 | 127.30 | 12.73 | 0.232 | 1.159 |
| 39 | 70.90 | 141.79 | 56.21 | 0.337 | 128.90 | 12.89 | 0.225 | 1.124 |
| 40 | 71.75 | 143.50 | 54.50 | 0.327 | 130.46 | 13.04 | 0.218 | 1.090 |
| 41 | 72.58 | 145.17 | 52.83 | 0.317 | 131.97 | 13.20 | 0.211 | 1.057 |
| 42 | 73.40 | 146.79 | 51.21 | 0.307 | 133.45 | 13.34 | 0.205 | 1.024 |
| 43 | 74.19 | 148.38 | 49.62 | 0.298 | 134.89 | 13.49 | 0.198 | 0.992 |
| 44 | 74.96 | 149.92 | 48.08 | 0.288 | 136.29 | 13.63 | 0.192 | 0.962 |
| 45 | 75.71 | 151.42 | 46.58 | 0.279 | 137.66 | 13.76 | 0.186 | 0.932 |

Example 2

A cross-linked microabrasive sample in the form of a 4-×-6-×-1 inch blank, was formed from a slip containing 32.5 volume-percent (64.23 weight-percent) solids. The slip included water (104.29 g); Kelcogel® KA50 gellan gum (0.625 g) (from NutraSweet Kelco Co., St. Louis, Mo., USA); 600-grit (10-12 micron) alumina abrasive grain (175.18 g) (obtained from Saint-Gobain Industrial Ceramics, Worcester, Mass., USA); glass bond mixture (17.527 g) (VH bond mixture, as described in U.S. Pat. No. 5,401,284, Example 1, obtained from Norton Company, Worcester, Mass.), $CaCl_2.2H_20$ (0.417 g); and Darvan® 821A polyacrylate (2.086 g) (from R. T. Vanderbilt, Norwalk, Conn., USA). The ingredients were mixed and heated to 80° C. to form a uniform, heated slurry. The heated slurry was then poured in a mold and allowed to cool in a freezer until the Kelcogel® KA50 polymer formed a cross-linked structure.

The sample was removed from the freezer, air dried for about two hours and then fired in a furnace at a 30° C./hr. ramp to 1000° C., where it was held for 4 hours. Power to the furnace was then shut off to allow the sample to cool naturally.

For comparison, another microabrasive sample was formed by cold-pressing a composition comprising a 600-grit alumina Norton Company commercial product mixture of abrasive grain and bond (i.e., a mix used to make Norton Company NSA600H8V product), containing 84.7 weight-percent grain and 15.3 weight-percent bond. This sample was fired similarly to the cross-linked microabrasive sample.

The cross-linked sample had a density of 1.59 g/cm$^3$, while the commercial mix cold-pressed comparative sample had a density of 1.75 g/cm$^3$.

Hardness variability in each microabrasive sample was determined by making six hardness measurements on the surface of the sample (three on top; three on the bottom). From these six measurements, the average hardness value and standard deviation were calculated. The percent hardness variability (% Hv) was then calculated as the standard deviation divided by the average hardness value and expressed as a percentage, as shown in the following formula:

$$\% \ Hv = 100 * \frac{(Std.Dev.)}{(Ave.H)}$$

Hardness (H) values for the cross-linked and pressed samples, expressed in Atlantic-Rockwell units, are provided in Table 3, below, along with the standard deviation of these values as well as the percent hardness variability.

TABLE 3

| | Ave. H | Std. Dev. | % Hv |
|---|---|---|---|
| Comparative Pressed blank | 119 | 12 | 9.7 |
| Gel-cast blank Invention | 128 | 8 | 6.2 |

Figure 2B:
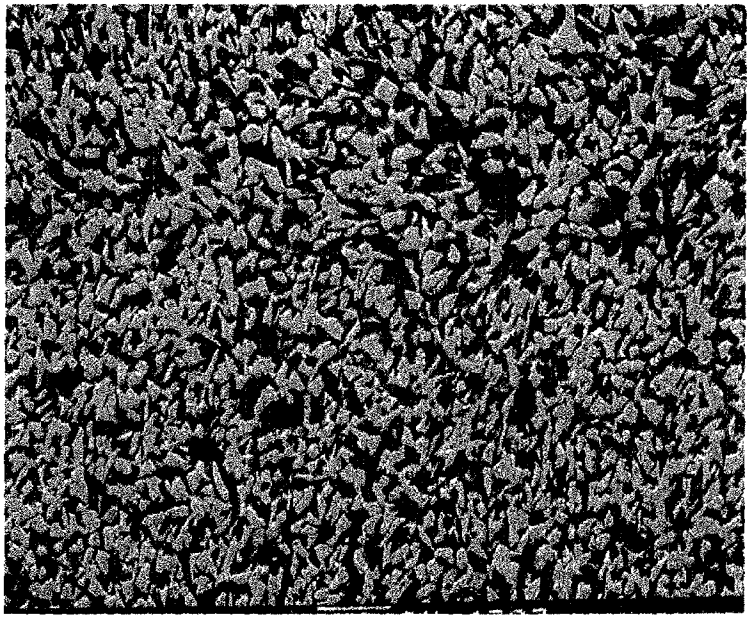
FIG. 2B is an SEM micrograph illustrating, at 250-times magnification, the dispersion of the abrasive (light) in the bond (dark) in a cross-linked microabrasive sample of this invention.
Figure 2A:
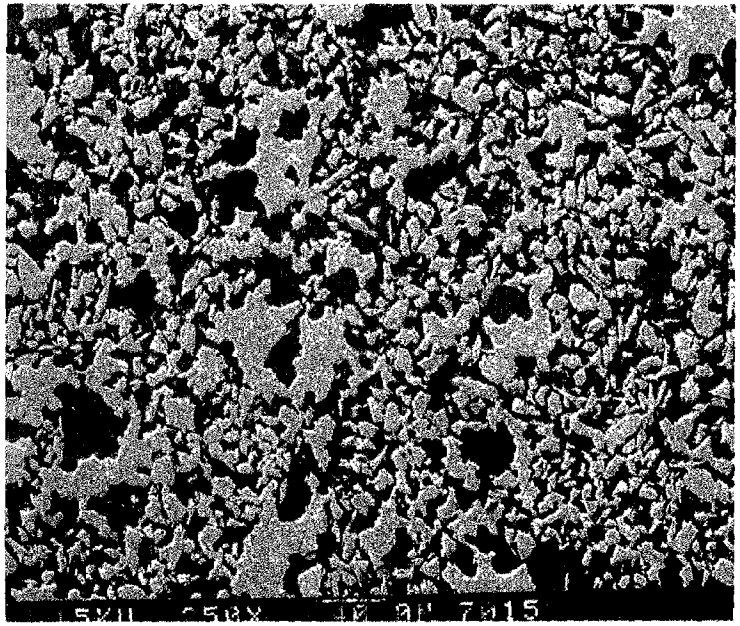
FIG. 2A is an SEM micrograph illustrating, at 250-times magnification, the dispersion of the abrasive (light) in the bond (dark) in a pressed microabrasive sample.

FIGS. 2A and 2B are comparative micrographs from a scanning electron microscope of the pressed and cross-linked samples, respectively. The magnification in both images is 250 times. By comparing the images, one can readily see that the lighter-colored alumina particles are dispersed more uniformly throughout the dark-colored glass bond in the cross-linked sample of FIG. 2B than they are in the pressed sample of FIG. 2A to give a homogeneous product.

Figure 3B:
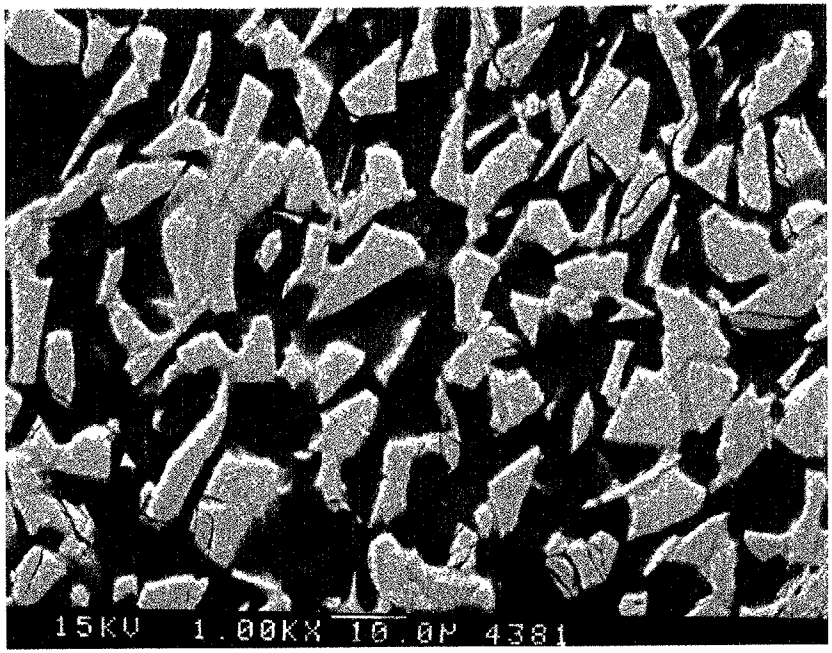
FIG. 3B is an SEM micrograph illustrating, at 1,000-times magnification, the dispersion of the abrasive (light) in the bond (dark) in a cross-linked microabrasive sample of this invention.
Figure 3A:
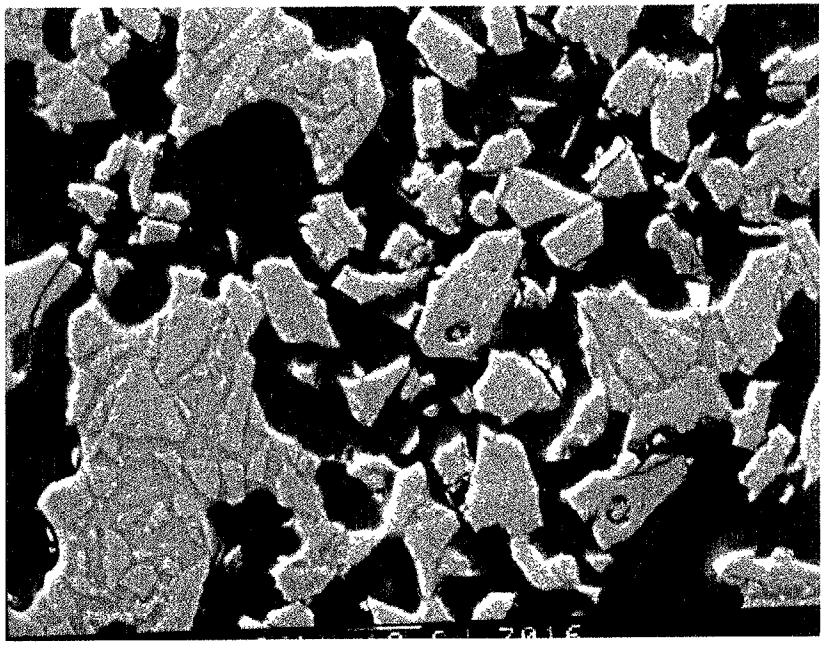
FIG. 3A is an SEM micrograph illustrating, at 1,000-times magnification, the dispersion of the abrasive (light) in the bond (dark) in a pressed microabrasive sample.

The images of FIGS. 3A and 3B include higher-magnification micrographs of the pressed and cross-linked samples, respectively. The magnification of these images is 1,000 times. Again, one can readily see that the lighter-colored alumina abrasive is more-uniformly dispersed in the dark-colored glass bond in the cross-linked sample of FIG. 3B than it is in the pressed sample of FIG. 3A.

EQUIVALENTS

While this invention has been particularly shown and described with references to preferred embodiments thereof, it will be understood by those skilled in the art that various changes in form and details may be made therein without departing from the scope of the invention encompassed by the appended claims inclusive of equivalents to what is therein defined.

What is claimed is:

1. A slurry, comprising:
a) a liquid;
b) abrasive grains;
c) a vitreous bonding material;
d) an ionically cross-linkable polymer; and
e) at least one cross-linking agent.

2. A slurry, comprising:
a liquid;
abrasive grains;
a bonding material;
an ionically cross-linkable polymer; and
at least one cross-linking agent,
wherein the cross-linking agent is selected from the group consisting of calcium chloride and yttrium nitrate.

3. The slurry of claim 1, wherein the liquid includes deionized water.

4. The slurry of claim 3, wherein the liquid further includes a dispersant.

5. A slurry, comprising:
a) a liquid;
b) abrasive grains;
c) a bonding material;
d) an ionically cross-linkable polymer; and
e) at least one cross-linking agent,
wherein the liquid includes deionized water and a dispersant that includes ammonia polyacrylate.

6. The slurry of claim 1, wherein the abrasive grains include alumina.

7. A slurry, comprising:
a) a liquid;
b) abrasive grains;
c) a bonding material;
d) an ionically cross-linkable polymer; and
e) at least one cross-linking agent,
wherein the abrasive grains include silicon carbide.

8. The slurry of claim 1, wherein the diameter of the abrasive grains is in a range of between about one micron and about thirty microns.

9. The slurry of claim 1, wherein the abrasive grains are present in the slurry in an amount in the range of between about 55 weight percent and about 70 weight percent of the slurry.

10. A slurry, comprising:
a) a liquid;
b) abrasive grains;
c) a bonding material;

d) an ionically cross-linkable polymer; and e) at least one cross-linking agent, wherein the bonding material includes a glass frit.

11. The slurry of claim 10, wherein the glass flit includes aluminosilicate glass.

12. The slurry of claim 11, wherein the glass flit particles have an average diameter in a range of between about five microns and about thirty microns.

13. The slurry of claim 12, wherein the glass fit particles are present in an amount in a range of between about 3.5 weight percent and about 7 weight percent of the slurry.

14. The slurry of claim 1, wherein the ionically cross-linking slurry includes a water-soluble polysaccharide.

15. The slurry of claim 14, wherein the water-soluble polysaccharide includes a food grade heteropolysaccharide.

16. The slurry of claim 15, wherein the food grade heteropolysaccharide includes gellan gum.

17. The slurry of claim 1, wherein the ionically cross-linking polymer includes sodium alginate.

18. The slurry of claim 1, wherein the ionically cross-linking polymer is present in an amount in a range of between about 0.2 weight percent and about 1.0 weight percent of the combined polymer and liquid weight.

19. A green-stage article, comprising:

a) abrasive grains;

b) a vitrified glass; and c) an ionically cross-linked polymer.

20. The article of claim 19, wherein the abrasive grains include alumina.

21. The article of claim 19, wherein the abrasive grains include silicon carbide.

22. The article of claim 19, wherein the diameter of the abrasive grains is in a range of between about one micron and about thirty microns.

23. The article of claim 19, wherein the vitrified glass includes aluminosilicate glass.

24. The article of claim 19, wherein the ionically cross-linked polymer includes a water-soluble polysaccharide.

25. The article of claim 24, wherein the water-soluble polysaccharide includes a food grade heteropolysaccharide.

26. The article of claim 25, wherein the food grade heteropolysaccharide includes gellan gum.

27. The articles of claim 25, wherein the food grade heteropolysaccharide includes sodium alginate.

* * * * *

UNITED STATES PATENT AND TRADEMARK OFFICE

CERTIFICATE OF CORRECTION

PATENT NO. : 7,015,268 B2
APPLICATION NO. : 10/050662
DATED : March 21, 2006
INVENTOR(S) : Kenneth E. Manwiller and Anne B. Hardy It is certified that error appears in the above-identified patent and that said Letters Patent is hereby corrected as shown below:

Column 10,
Line 29, before "a liquid;" insert -- a) --.
Line 30, before "abrasive grains;" insert -- b) --.
Line 31, before "a bonding material;" insert -- c) --.
Line 32, before "an ionically cross-linkable polymer; and" insert -- d) --.
Line 33, before "at least one crossing agent," insert -- e) --.

Signed and Sealed this

Twentieth Day of June, 2006

JON W. DUDAS
*Director of the United States Patent and Trademark Office*